US005588172A

United States Patent [19]

Biocca

[11] Patent Number: 5,588,172

[45] Date of Patent: Dec. 31, 1996

[54] RADIAL BRUSH

[75] Inventor: Peter M. Biocca, Rochester, N.Y.

[73] Assignee: Abtex Corporation, Dresden, N.Y.

[21] Appl. No.: 273,379

[22] Filed: Jul. 11, 1994

[51] Int. Cl.[6] ..... A46B 3/02; A46B 13/02

[52] U.S. Cl. ..... 15/179; 15/183; 15/193; 15/207.2; 451/466; 451/496

[58] Field of Search ..... 15/179, 181–183, 15/186, 187, 192, 193, 200, 202, 207.2; 451/466, 469, 496, 497

[56] References Cited

U.S. PATENT DOCUMENTS

| | | | |
|---|---|---|---|
| 541,793 | 6/1895 | Schenck . | |
| 951,432 | 3/1910 | Bowditch | 15/192 |
| 1,871,007 | 8/1932 | Raisch | 15/179 |
| 2,303,800 | 12/1942 | Swann | 15/183 |
| 2,317,485 | 4/1943 | Rider | 15/207.2 |
| 2,604,362 | 7/1952 | Sugerman et al. | 300/21 |
| 2,634,167 | 4/1953 | Bible, Jr. | 300/21 |
| 2,643,158 | 6/1953 | Baldanza | 300/21 |
| 2,655,409 | 10/1953 | Baldanza | 300/21 |
| 2,659,632 | 11/1953 | Enchelmaier | 15/193 |
| 2,843,980 | 7/1958 | Bernstein et al. | 451/496 |
| 3,053,021 | 9/1962 | Block | 451/469 |
| 3,120,671 | 2/1964 | Miller | 15/193 |
| 3,200,430 | 8/1965 | Haracz | 15/183 |
| 3,216,034 | 11/1965 | Johnson | 15/23 |
| 3,217,074 | 11/1965 | Gould et al. | 15/207.2 |
| 3,290,714 | 12/1966 | Enchelmaier | 15/182 |
| 3,307,211 | 3/1967 | Gaines | 15/4 |
| 3,327,339 | 6/1967 | Lemelson | 15/207.2 |
| 3,373,739 | 3/1968 | Rankin . | |
| 3,390,412 | 7/1968 | Wolter et al. | 15/23 |
| 3,610,692 | 10/1971 | Van Der Molen | 300/11 |
| 3,822,432 | 7/1974 | Skinner | 15/23 |
| 4,092,758 | 6/1978 | Horton et al. | 15/180 |
| 4,133,147 | 1/1979 | Swift, Jr. . | |
| 4,457,040 | 7/1984 | Hettes | 15/180 |
| 4,488,760 | 12/1984 | Weiler | 300/21 |
| 4,504,997 | 3/1985 | Weiler | 15/179 |
| 5,016,311 | 5/1991 | Young et al. | 15/183 |
| 5,108,155 | 4/1992 | Hettes et al. | 300/21 |
| 5,155,875 | 10/1992 | Kirkkala et al. | 15/183 |
| 5,400,458 | 3/1995 | Rambosek | 15/179 |

FOREIGN PATENT DOCUMENTS

| | | | |
|---|---|---|---|
| 518013 | 3/1953 | Belgium | 15/183 |
| 0196928 | 8/1986 | European Pat. Off. . | |
| 448817 | 2/1913 | France | 15/183 |
| 0815034 | 7/1949 | Germany . | |
| 1005928 | 9/1955 | Germany . | |
| 1109140 | 6/1961 | Germany | 15/179 |
| 2709899 | 3/1977 | Germany . | |
| 131222 | 4/1951 | Sweden | 15/179 |
| 292 | 1/1881 | United Kingdom | 15/182 |
| 8971 | 4/1902 | United Kingdom | 15/183 |
| 386633 | 4/1931 | United Kingdom | 15/183 |
| 1097198 | 12/1967 | United Kingdom | 15/183 |
| 2165742 | 9/1985 | United Kingdom . | |

*Primary Examiner*—Mark Spisich
*Attorney, Agent, or Firm*—Cumpston & Shaw

[57] ABSTRACT

A radial brush having a plurality of discrete brush segments mechanically affixed to or mechanically affixed to and bonded to a central core. Each brush segment is a preformed discrete component having a predetermined degree of splay. The brush segments are affixed to the core for rotation about an axis of rotation, so that splay of the individual fibers lies in a plane orthogonal to the axis of rotation and splay in the axial direction may be precluded.

9 Claims, 3 Drawing Sheets

RADIAL BRUSH

The present invention relates to radial brushes, and more particularly, to a radial abrasive brush having a plurality of discrete abrasive fiber brush segments attached to a core. Each brush segment includes a plurality of individual fibers, wherein the individual fibers are bonded to each other to preclude axial splay and exhibit a radial splay of a predetermined degree in a plane orthogonal to the axis of rotation. Adjacent segments are affixed relative to each other so that the fibers in adjacent segments contact each other over substantially the entire trim height.

BACKGROUND OF THE INVENTION

Radial brushes are used to remove sprues, clean, debur, polish, radius and finish surfaces of a workpiece. Radial brushes may be used to rotate a plurality of abrasive or nonabrasive fibers relative to the workpiece. The contact of the fibers and the workpiece imparts the energy of the rotating fiber to the surface of the workpiece, thereby conditioning the surface.

A variety of brush configurations have been used to rotate abrasive fibers relative to a workpiece. In each configuration, a plurality of fibers must be attached to a central core for rotation with the core. The core may be of any of a variety of designs including a rim, a planar disk, or a cup. The retention of the individual fibers relative to the rotating core has been achieved by tying or knotting the individual fibers to the core, or embedding the fibers in an adhesive, wherein the adhesive forms the central core as in U.S. Pat. No. 5,155,108 issued to Hettes et al., or bending a fiber about an inner ring.

To increase the dimension of the brush face along the axis of rotation, the inner end of the fibers are compressed along the axis of rotation, so that the outer end of the fibers are splayed to increase the axial dimension of the face. The splay increases the face width of the brush, thereby providing a larger contact area with the workpiece. When a face width greater than a single brush is desired, a plurality of disks are disposed upon a common axis, and axially abutted to increase the face width. However, as the fibers are splayed along the axis of rotation when the trim height decreases, discontinuities in the brush face are formed.

An alternative configuration is disclosed in U.S. Pat. No. 4,457,040 issued to Hettes for an Industrial Wire Cup-Shaped Brush. The Hettes brush includes elongated supports on a knot plate for anchoring the bristles to the supports by elongated loops of a generally complementary shape to the elongated supports. Although the cup brush may be formed in a variety of sizes, the cup-shaped brush provides only a limited face width.

A further attempt to provide a brush includes the retention of a plurality of flaps about the periphery of a disk. The periphery of the disk includes a plurality of sockets and each flap includes a male end for rotatable retention in the socket. Each flap is individually rotatable relative to the disk, as the disk rotates about a central axis. While the flap brush provides an increased face width over the disk or cup brushes, the flaps do not provide a continuous circumferential face. That is in order for the flap brush to operate, there must be sufficient distance between the flaps so that each flap may contact a planar surface against the workpiece.

An alternative abrasive brush is disclosed in U.S. Pat. No. 4,133,147 issued to Swift for Abrasive Brushes and Methods of Making Same. The Swift patent discloses an abrasive brush formed by a knit abrasive filament wound about a core so that the transverse sections of the monofilaments in each strip flare radially outwardly as spokes from the core. However, Swift does not provide a radial brush having a uniform circumferential face.

Therefore, a need exists for a radial brush having an increased face width without a reduced fiber density. A further need exists for a radial brush which may be constructed without restricting the available face width. A need also exists for a method of manufacturing a high density radial abrasive brush.

SUMMARY OF THE INVENTION

The radial brush of the present invention includes a plurality of preformed discrete brush segments, wherein each brush segment includes a plurality of individual fibers bonded together. The individual fibers are aligned substantially parallel to a first plane. The first plane is orthogonal to the axis of rotation and the fibers exhibit a predetermined degree of splay in the direction of rotation. That is, the fibers are substantially parallel to the first plane and non-parallel to a second plane which includes the axis of rotation. In order to attain the necessary fiber density at the face of the brush, the inner ends of the fibers must be densely packed. Once the desired trim height is determined, the object is to maximize the fiber density for the given core size.

Preferably, each brush segment is formed of a predetermined weight of parallel fibers, and has an inner end and an outer end, wherein the fibers terminate at a face at the outer end of the brush segment. The inner end of the brush segment includes a base at which the inner ends of the individual fibers are bonded to each other. The base may be any of a variety of configurations, such as substantially rectangular, or square or any other desired shape. In a first embodiment, the preformed brush segments are bonded to each other or a core for rotation about an axis. In a second embodiment, the base and the core include complementary interlocking mechanical configurations for precluding displacement of the brush segment relative to the core upon operable rotation of the brush. Alternatively, the segments can be connected to the core by a combination of interlocking structures and bonding.

The radial brush is manufactured by forming a plurality of brush segments and affixing the brush segments to the core. Each segment is formed by aligning the fibers in a holder, and wetting the free ends. The wetted ends are retained in a mold to form the base portion. Preferably, the mold defines a base which splays the fibers at the face. Upon removal from the mold, the brush segments are affixed to the core to orient the fibers parallel to a plane which is perpendicular to the axis of rotation. In a first embodiment, the brush segments are integrally bonded to the core. In a second embodiment, each brush segment includes a component of a mechanical interlocking structure. The interlocking structure cooperates with a corresponding structure on a core to mechanically connect each preformed brush segment to the core.

As the brush segments are substantially composed of the fibers themselves and the core may be formed of a lightweight material, the ratio of fiber weight to total brush weight is increased over brushes of the prior art. In addition, as the radial brush is formed of a plurality of individual discrete preformed brush segments, which may be manufactured to substantially identical weight, the brush is balanced for rotation about an axis. Further, the present construction allows for ganging a plurality of brushes along an axis, wherein adjacent brushes abut along the entire length of the trim height to form a continuous fiber density along the axis of rotation. That is, the fiber density at the face remains uniform throughout the height of a ganged brush.

DETAILED DESCRIPTION OF THE PREFERRED EMBODIMENT

Figure 1:
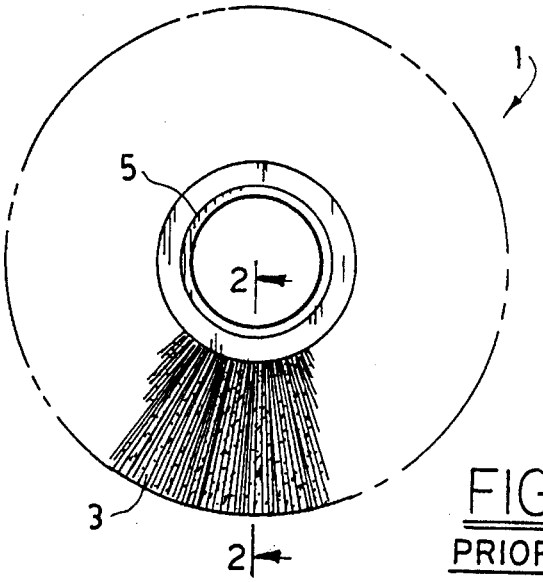
FIG. 1 PRIOR ART
FIG. 1 is a top plan view of a radial brush of the prior art.
Figure 2:
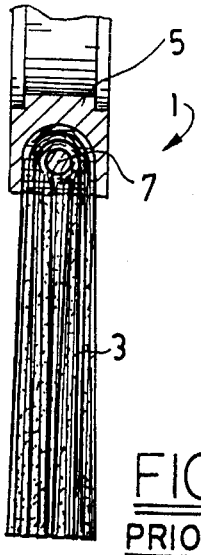
FIG. 2 PRIOR ART
FIG. 2 is a cross sectional view taken along lines 2—2 of FIG. 1 showing the radial brash of the prior art.

Referring to FIGS. 1 and 2, a radial brush 1 of the prior art is disclosed. The prior art employs a plurality of U-shaped strands 3 wherein the closed end of the strands are retained within a core 5. The closed ends are looped about a ring 7 and are compressed adjacent the ring in a direction parallel to the axis of rotation to splay the free ends along a direction parallel to the axis of the rotation (axial splay).

Figure 6:
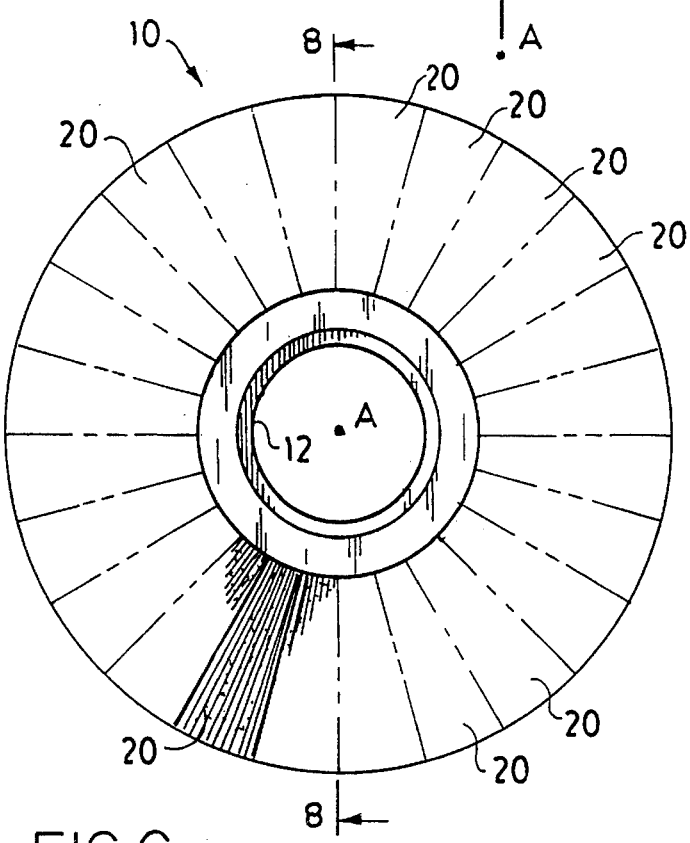
FIG. 6 is a top plan view showing a operable positioning of a plurality of brush segments forming a radial brush.
Figure 8:
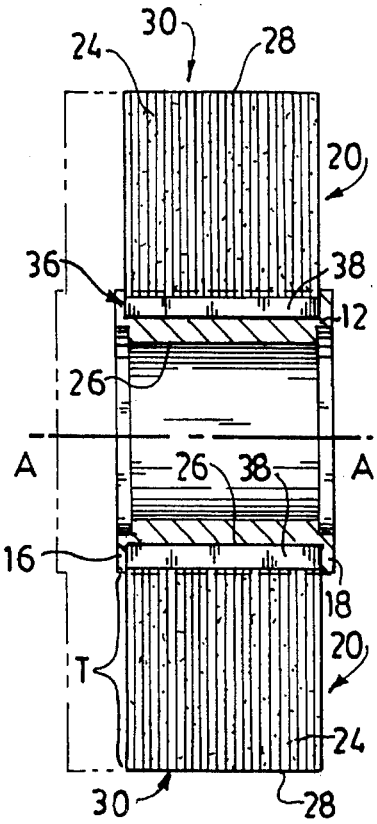
FIG. 8 is a cross sectional view taken along lines 8—8 of FIG. 6.
Figure 9:
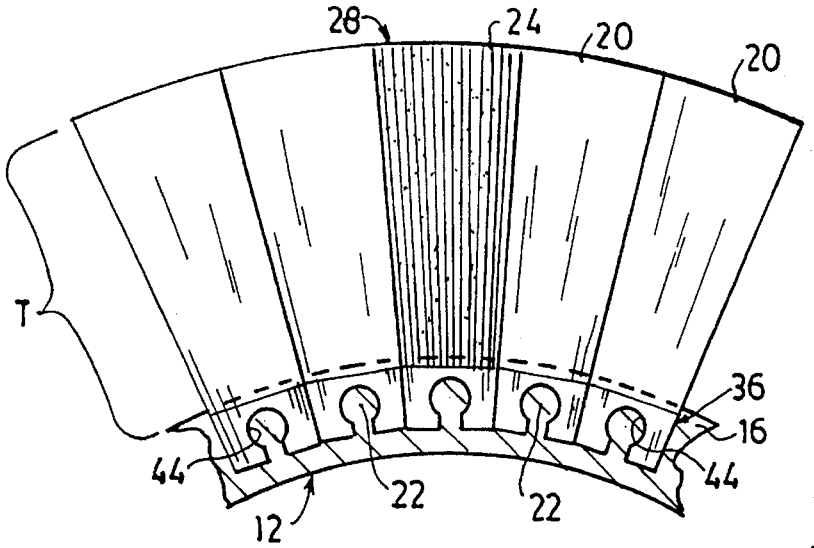
FIG. 9 is a partial top plan view of the second embodiment of the brush segments interlocked to the core.

Referring to FIGS. 6, 8 and 9, the radial brush 10 of the present invention includes a plurality of preformed brush segments 20 affixed relative to a core 12 for rotation about an axis A. Although the present invention is described as employing fibers, the fibers may be formed of a variety of materials such as nylon, polypropylene or other similar materials. Alternatively, the fibers may be an abrasive material. In addition, the fibers may have circular, rectangular, square, oval or any other cross section, wherein the fibers are aligned within each brush segment in a predetermined orientation or randomly referring to FIG. 11, the fibers may have a cross-section defined by first dimension and second longer perpendicular dimension and the fibers are bonded in the brush segment 20 so that the second longer dimension is parallel to the axis of rotation.

The radial brush 10 may be formed by bonding a plurality of preformed brush segments relative to each other to form a self supporting ring; bonding the brush segments to the central core 12; engaging a locking portion of the brush segment with a corresponding locking segment of the core to operably retain the brush segment relative to the core; or any combination thereof. While the present description is directed to forming a radial brush with a uniform or constant fiber density at the face. The present method may be used to form a brush having spaced apart fibers or predetermined gaps in the face.

The central core 12 is adapted for rotation about an axis A. The core 12 has an inner diameter and an outer diameter, wherein the inner diameter is adapted to cooperate with a rotating shaft or mandrel (not shown). The inner diameter may be configured to accept an adapter (not shown) or directly engage the shaft, as is well known in the art. The outer diameter provides a engaging surface for the plurality of brush segments 20. The core 12 is formed from a rigid material, such as metal or plastics such as Lexan. In the first embodiment, the core 12 is formed of an extruded aluminum. The outer surface of the core 12 may include grooves (not shown) or ridges to increase the bond strength between the preformed brush segments 20 and the core.

In the second embodiment; the core 12 is formed of a plastic or plastic composite such as Lexan or urethane. The second embodiment of the core 12 includes a plurality of locking stations 22 circumferentially spaced about the core. The locking stations 22 are shown as spaced an equal radius from the axis. However, the locking stations 22 may be at varying distances from the axis A as dictated by the desired performance characteristics of the brush. The second embodiment of the core 12 may also include a first and a second flange 16, 18, such that the locking stations 22 are intermediate the first and second flanges. One of the flanges 16, 18 may be separate and subsequently affixed to the core 12 by adhesives, bonding or ultra sonic welding as well as known in the art. One or both of the first and second flanges 16, 18 may engage the locking stations 22 to operably retain the flange relative to the core 12. Alternatively, the core 12 may be formed in halves, substantially bisecting the core along a plane orthogonal to the axis of rotation. The core may be formed by injection molding, casting, machining or other process as known in the art. The core 12 may be formed to accommodate a variety of brush sizes. That is, the core may 12 have an axial dimension from less than 1" to over 3".

As shown in FIGS. 5–8, each preformed brush segment 20 is a discrete component, and includes a plurality of fibers 24. Each brush segment has an inner end 26 and an outer end 28. The fibers are affixed relative to each other at the inner end 26 to form a base 36. The fibers 24 extend from the base 36 and terminate at the outer end 28. The outer end 28 forms a face 30 which provides the contact area of each brush segment with the workpiece (not shown). Collectively, the outer ends 28 of the individual brush segments 20 form the circumferential face of the radial brush for contacting the workpiece. The length of fiber between the base 36 and the outer end 28 is the trim height of the brush, shown as T in FIGS. 5, 7, 8, 9 and 11.

Referring to FIG. 8, each individual fiber 24 within the each brush segment 20 lies in a plane orthogonal to the axis of rotation A. As shown by the phantom outline in FIG. 8, the brush segments may be formed to provide radial brushes having different face widths. A plurality of brushes may be ganged along the axis of rotation to provide a face having any desired axial dimension. As the fibers within each segment 20 lie in a plane substantially orthogonal to the axis of rotation, the fibers in adjacent brushes in a ganged assembly are separated by only the width of the flanges 16, 18. Therefore, brushes for operation in a gaged environment may be formed without flanges 16, 18, allowing adjacent brushes to about along the axis of rotation, or include flanges having a reduced thickness.

In addition, the fibers within each segment 20 and in adjacent segments are operably located to be substantially adjacent from the base 36 to the outer end, thereby providing a substantially uniform fiber density at the face of the brush.

Figure 7:
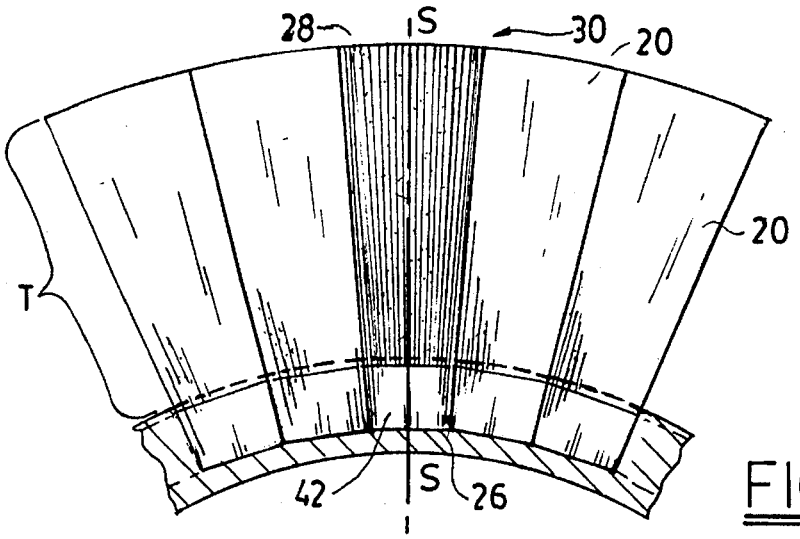
FIG. 7 is an enlarged top plan view of a portion of a radial brush in accordance with the first embodiment.

Referring to FIGS. 6, 7 and 9, the individual fibers 24 circumferentially diverge as they radially extend away from the axis A. That is, in the operating configuration, the individual fibers 24 within each brush segment 20 are substantially parallel to a first plane which is orthogonal to the axis of rotation A, and non-parallel to a second plane orthogonal to the first plane. For each brush segment 20, substantially all fibers 24 are non-parallel to the second plane. However, as shown in FIG. 7, the brush segment 20 has a plane of symmetry S extending parallel to the second plane, the fibers 24 lying substantially in the plane of symmetry S are parallel to the second plane. The remaining fibers, being substantially all the fibers in the brush segment 20, are nonparallel to the second plane.

Figure 5:
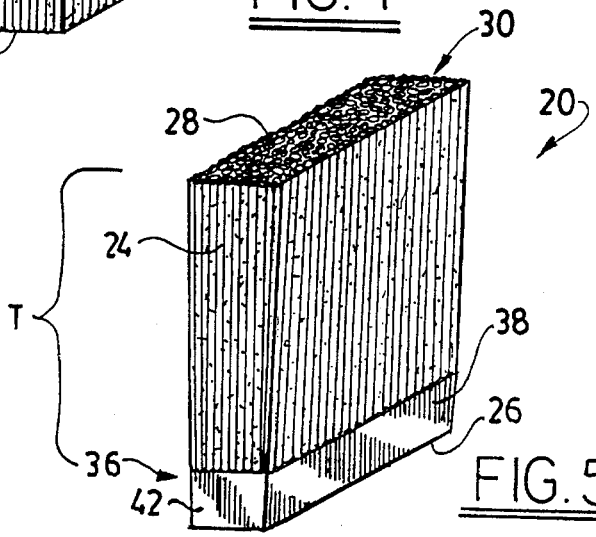
FIG. 5 is a perspective view of the first embodiment of brush segment.
Figure 11:
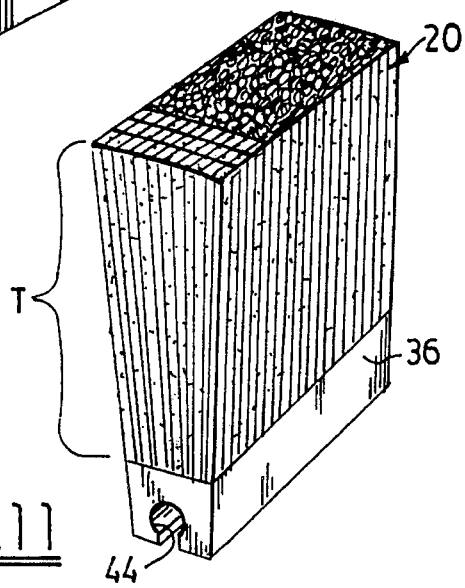
FIG. 11 is a perspective view of a brush segment of the second embodiment.

Referring to FIGS. 5, 9 and 11, the base 36 includes both the bonding of the individual fibers 24 in the brush segment 20, and the portion to be connected to the core or adjacent brush segment. In the first embodiment, the base 36 is defined by a rectangular periphery having a pair of opposing longitudinal side walls 38 and a pair of transverse opposing end walls 42. The side walls 38 and end walls 42 are substantially planar surfaces. Preferably, as shown in FIG. 7, the side walls 38 are slightly tapered along a direction substantially perpendicular to the axis A about which the brush is rotated so that adjacent brush segments abut along a common plane. In the first embodiment, the bottom of the fibers 24 in a brush segment 20 form a substantially planar surface comprising an adhesive and the inner ends 26.

Referring to FIG. 6–8, the brush segments 20 are disposed about the axis of rotation A so that the side walls 38 of each brush segment are substantially parallel to the axis A and contact the side wall of the adjacent brush segment. The brush segments 20 are then affixed relative to each other, or to the core 12, so that side walls 38 of adjacent brush segments occupy a common plane, and the faces 30 form a substantially continuous circumferential face having a uniform fiber density.

Figure 10:
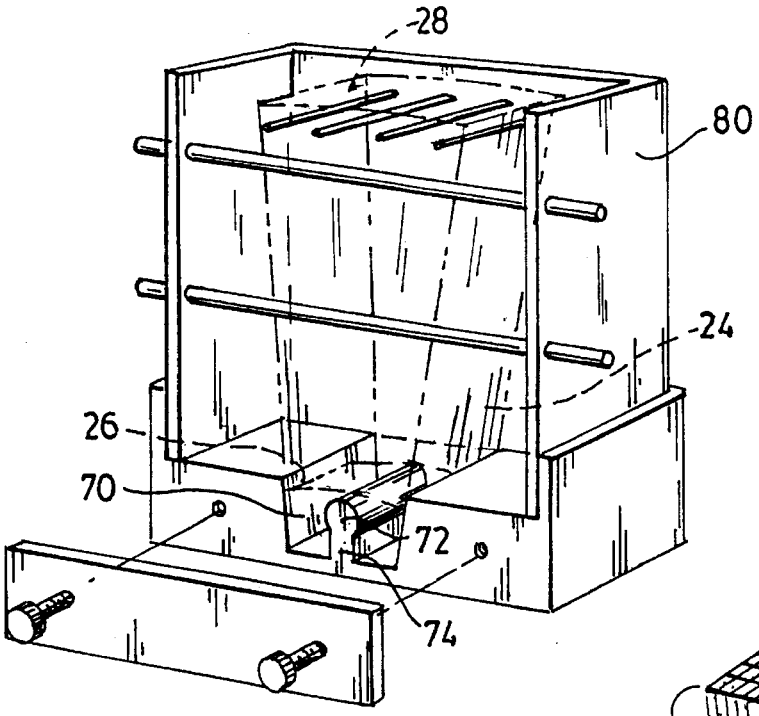
FIG. 10 is a perspective view showing the formation of a brush segment in a mold.

As shown in FIGS. 9–11 in the second embodiment, the base 36 includes a locking portion 44 for engaging a corresponding locking member 22 on the core 12 to nonrotatably and mechanically retain the brush segment 20 relative to the core 12. As shown in FIGS. 9 and 11, the base 36 includes the bonding of the inner ends of the individual fibers as well as the locking portion 44. The locking portion 44 of the brush segment 20 and the locking station 22 on the core 12 may be any of a variety of mechanical interlocking configurations known on the art, such as spline and keyway, bulbous portion and mating channel, friction snap fits, rotation connections or male and female components. As shown in FIGS. 9 and 11, the locking portion 44 of the brush segment 20 has a substantially keyhole cross section. The longitudinal axis of the keyhole is parallel to the axis of rotation A. The mechanical interlocking of the brush segment 20 and the core 12 precludes displacement of the brush segment relative to the core upon rotation of the brush. Preferably, each brush segment 20 is fixedly attached to the core 12 by the mechanical interconnection, and the bonding of the flange 16, 18 to the core precludes unseating of the mechanical interconnection. That is, if the direction of interconnection and release of the brush segment 20 and the core 12 is accomplished along a direction parallel to the axis of rotation, then the mechanical interlock is sealed by affixing the flanges 16, 18 to the core.

METHOD OF MANUFACTURE

The radial brush 10 of the present invention is formed by attaching a plurality of preformed fiber brush segments 20 to the core 12 for rotation about axis A. In the first embodiment, the brush segments are bonded to each other to form a ring or bonded to the core 12. Preferably, each brush segment 20 is interchangeable, so there is no preferred location of a given brush segment with respect to the core 12.

First Embodiment

Although the brush segments 20 may be any configuration and relative size, the first embodiment is described in terms of a radial abrasive brush having an inner core diameter of 6", a 4" trim height, a 3" face width, and an outer diameter of approximately 15". In this embodiment, forty-four brush segments 20 are used.

Figure 3:
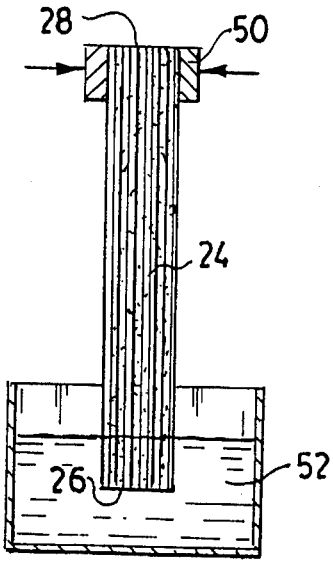
FIG. 3 is a side elevational view showing formation of a brush segment of the first embodiment of the present brush.

Depending upon the desired characteristics of the brush 10, the density of the fibers, the desired trim height and face width, an initial weight of fibers for each brush segment 20 is determined. The preferred abrasive fiber is Tynex A, as manufactured by E. I. Du Pont. Referring to FIG. 3, the desired trim height is cut, and the fibers 24 are aligned parallel to each other and retained at one end in a jig 50.

The ends of the fibers 24 not retained in the jig 50 are dipped in an adhesive 52. A preferred adhesive 52 is liquid urethane Conap TU-89 manufactured by Conap Company of Olean, N.Y. The fibers 24 are dipped in the adhesive 52 so that the adhesive extends from approximately ⅛ to 3/16 inches from end of the fibers.

Figure 4:
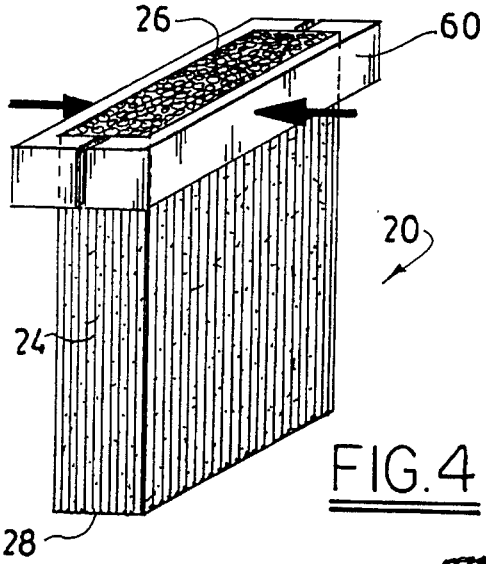
FIG. 4 is a perspective view showing formation of a brush segment of the first embodiment.

As shown in FIG. 4, the wetted ends of the fibers 24 are then disposed in a mold 60. The mold 60 defines a substantially rectangular periphery. The mold 60 forms the wetted fiber ends, and causes the adhesive 52 to extend to approximately ⅓ inch from the end of the fiber 24. Preferably, the adhesive does not extend further than ⅓ inch from the end of the fiber, as excess adhesive stiffens the brush segment 20 and adversely effects the density of the face 30. The mold 60 is configured to restrict the periphery of the brush segment by splaying each side wall 38 approximately 8° from a parallel orientation. That is, the total splay for each brush segment 20 is 16°. In the disclosed method, approximately 8% of the urethane initially wetting the fiber ends is expelled during the compression process.

Referring to FIGS. 7 and 8, the mold 60 retains the brush segments 20 in an orientation to slightly splay the fibers in a direction that will ultimately be perpendicular to the axis of rotation A of the brush, while maintaining the fibers in a substantially parallel orientation along the axis of rotation. That is, all fibers are parallel to the first plane which is perpendicular to the axis of rotation A, and substantially all the fibers are non-parallel to the second plane which is orthogonal to the first plane and parallel to the axis of rotation.

The degree of splay is a factor of the brush size and the desired fiber density at the circumferential face. The higher the desired fiber density at the circumferential face, the less degree of splay. This increases the number of brush segments 20 and fibers 24 employed for a given size brush 10. Alternatively, if a lower fiber density is desired, the degree of splay is increased. This reduces the number of brush segments and fibers for a given core size. The degree of splay is determined by the specific application of the brush 10.

The urethane adhesive is cured at room temperature to bond the individual fibers 24 in the brush segment 20 to each other, and form the base portion 36 by substantially planar side and end walls 38, 42. In addition, the bottom of the base portion is a non-porous surface of urethane. The curing process may be accelerated by heating the urethane above room temperature. The free end of the fibers, the end previously held by the jig 50, are substantially co-terminus and are splayed due to the form of the mold of the brush segment 20 in the base portion 36. As shown in FIG. 5, the face 30 exhibits a substantially uniform fiber density.

The brush segments 20 may be affixed to the core 12 by a variety of methods. In each method, it is necessary that the bond between the brush segments 20 and the core 12 is sufficient to withstand the forces generated at the operating speed of the brush 10.

In the first embodiment, the preformed brush segments 20 are bonded to the core 12 by an adhesive. The individual preformed brush segments 20 are disposed about the core 12 so that the side walls 38 of adjacent brush segments occupy a substantially common plane. The brush segments 20 form a ring having a diameter greater than the diameter of the core 12. As adjacent side walls 38 contact, the bottoms of the brush segments 20 define a substantially continuous cylindrical surface having a diameter greater than the outer diameter of the core 12. The difference in diameters forms an annulus between the bottoms of the brush segments 20 and the core 12.

The same type of urethane adhesive used to form the brush segments 20 is used to affix the brush segments to the core 12. The urethane is disposed in the annulus to contact the bonding surface of the core 12 and the bottom of the brush segments 20. As the side walls 38 are planar and adjacent side walls occupy a common plane, the adhesive does not penetrate radially outwardly along the length of the fibers. Upon the curing of the urethane adhesive, the plurality of brush segments 20 are affixed relative to the core 12.

Alternatively, the brush segments may be affixed to each other to form a self supporting ring. The urethane adhesive may be used to bond the individual brush segments 20 together to form the brush 10.

Second Embodiment

In the second embodiment, the brush segments 20 are operably engaged with the core 12 without requiring adhesives. The base 36 includes the locking portion 44. The brush segments 20 may be formed substantially as described for the first embodiment, or may have a separate formation process.

For a radial brush employing fibers 24 that have a rectangular cross section, a predetermined number of fibers 24 are laid flat in a parallel side by side relation on a support surface. The fibers 24 are then bonded at one end to form a planar single layer tab. The tab is one fiber thick and has a width equal to the width of the predetermine number of fibers. A predetermined number of tabs are placed in a configured cassette 80. The fibers 24 within each tab remain parallel to each other and coplanar, however the unbonded end of a tab is separated from an adjacent tab by a larger distance than the bonded end. That is, adjacent tabs are splayed relative to each other as they extend from the inner end of the face. Adjacent tabs are not completely parallel. The cassette aligns the bonded end of the tabs, so that the outer ends of adjacent tabs are at least partially splayed.

Referring to FIG. 10, the cassette 80 is configured to be received within a mold 70. The mold 70 defines the final shape of the brush segment 20. The mold 70 has a sufficient depth to contact approximately 0.25 inches of the fibers 24 as well as approximately 0.5 inches for forming the locking portion 44. The mold 70 includes a configured bottom which defines the locking portion 44 of the brush segment 20. That is, in a preferred design of the second embodiment, the mold 70 includes an elongate cylindrical member 72 supported by a web 74. The cylindrical member 72 and the web 74 define the channel of the locking component 44 shown in FIGS. 9–11. The base 36 is formed of a curable material such as urethane as employed in the first embodiment.

Upon creation of the brush segment 20 in the second embodiment, the locking portion 44 of each brush segment is mechanically engaged with a corresponding locking station 22 on the core. The base 36 of each brush segment 20 is formed so that upon engagement with the core 12, adjacent bases contact along a common plane, and the fibers of adjacent brush segments contact along the entire trim height.

Although the present invention has been described in terms of particular embodiments, it is not limited to these embodiments. Alternative embodiments or modifications which would be encompassed by the invention may be made by those skilled in the art, particularly in light of the foregoing teachings. Alternative embodiments, modifications or equivalents may be included in the spirit and scope of the invention, as defined by the claim.

What is claimed is:

1. A radial brush for rotation about an axis, comprising:

(a) a core having a plurality of locking stations circumferentially spaced about the core; and (b) a plurality of preformed independent brush segments, each brush segment having an inner end and a spaced apart outer end, and a plurality of fibers integrally bonded at the inner end with free ends of the fibers defining the outer end, the inner end including a locking portion for mechanically engaging a respective one of the locking stations to operably affix the brush segment to the core and each brush segment including sides terminally defined by the inner end and the outer end of the brush segment;

the locking stations, locking portions and brush segments selected so that the entire side of each brush segment contacts the entire side of an adjacent brush segment, and the fibers of each segment extending parallel to a first plane, and the brush segments affixed relative to each other and the core to dispose the first plane orthogonal to the axis.

2. The radial brush of claim 1, wherein the locking stations are spaced about a common circumference.

3. The radial brush of claim 1, wherein each locking station includes a spline.

4. The radial brush of claim 1, wherein each locking portion includes a keyway.

5. The radial brush of claim 1, wherein each of the fibers has a cross section defined by a first dimension and a second longer dimension and the fibers are bonded in the respective brush segment so that the second dimension is parallel to the axis of rotation.

6. The radial brush of claim 1, wherein the plurality of fibers has a circular cross section.

7. The radial brush of claim 1, wherein the plurality of fibers has a square cross section.

8. A radial brush for rotation about an axis, comprising:

(a) a core having a plurality of locking stations circumferentially spaced about the core, each locking station having one of a male and a female locking component; and (b) a plurality of discrete preformed brush segments having an inner end, an outer end and a pair of sides extending from the inner end to the outer end, each brush segment having a plurality of fibers integrally bonded at the inner end to form a base with free ends of the fibers defining the outer end, the base including the remaining of the male and female locking component for operably engaging a respective one of the locking stations to preclude movement of the brush segment relative to the core upon rotation of the core about the axis;

the locking stations, locking portions and brush segments selected to contact the entire side of the brush segment with a respective side of an adjacent brush segment and the fibers of each segment extending parallel to a first plane, and the brush segments affixed relative to each other and the core to dispose the first plane orthogonal to the axis.

9. A radial brush for rotation about an axis, comprising:

(a) a core having a plurality of locking stations circumferentially spaced about the core; and (b) a plurality of preformed independent brush segments, each brush segment formed of a plurality of fibers having a terminal first end and a terminal second end, each brush segment having an inner end and a spaced apart outer end with the terminal second ends of the fibers defining the outer end, the terminal first ends of the plurality of fibers in a brush segment integrally bonded at the inner end, the inner end including a locking portion for mechanically engaging a respective one of the locking stations to operably affix the brush segment to the core, each brush segment including sides terminally defined by the inner end and the outer end of the brush segment;

the locking stations, locking portions and brush segments selected so that the entire side of each brush segment contacts the entire side of an adjacent brush segment, the fibers of each segment extending parallel to a first plane, and the brush segments affixed relative to each other and the core to dispose the first plane in a predetermined orientation relative to the axis.

* * * * *